United States Patent [19]

Kramer

[11] Patent Number: 4,898,070

[45] Date of Patent: Feb. 6, 1990

[54] ON-BOARD AMMUNITION CONTAINER

[75] Inventor: Bernhard Kramer, Markdorf, Fed. Rep. of Germany

[73] Assignee: Dornier GmbH, Freidrichshafen, Fed. Rep. of Germany

[21] Appl. No.: 147,809

[22] Filed: Jan. 25, 1988

[30] Foreign Application Priority Data

Jan. 24, 1987 [DE] Fed. Rep. of Germany ..... 3702119

[51] Int. Cl.[4] ..... F41D 10/36

[52] U.S. Cl. ..... 89/34; 89/37.19

[58] Field of Search ..... 89/33.1, 33.14, 33.2, 89/34, 37.19

[56] References Cited

U.S. PATENT DOCUMENTS

| | | | |
|---|---|---|---|
| 1,808,106 | 6/1931 | Green | 89/33.14 |
| 2,364,510 | 12/1944 | Bertran et al. | 89/34 |
| 2,375,437 | 5/1945 | O'Hare | 89/37.19 |
| 2,484,104 | 10/1949 | Lippert | 89/34 |
| 2,489,428 | 11/1949 | Mariner | 89/33.14 |
| 2,828,732 | 4/1958 | Horowitz et al. | 89/34 |
| 2,908,200 | 10/1959 | Linke | 89/33.14 |
| 3,170,372 | 2/1965 | Stanton et al. | 89/34 |
| 3,246,565 | 4/1966 | Ramseyer | 89/34 |
| 4,429,615 | 2/1984 | Morris | 89/33.14 |

FOREIGN PATENT DOCUMENTS

| | | | |
|---|---|---|---|
| 721979 | 6/1942 | Fed. Rep. of Germany | 89/33.1 |
| 126842 | 7/1928 | Switzerland | 89/33.14 |
| 223089 | 11/1942 | Switzerland | 89/33.14 |
| 574673 | 11/1945 | United Kingdom | 89/33.14 |
| 574672 | 12/1945 | United Kingdom | 89/33.14 |
| 642565 | 9/1950 | United Kingdom . | |

*Primary Examiner*—Stephen C. Bentley
*Attorney, Agent, or Firm*—Ralf H. Siegemund

[57] ABSTRACT

Ammunition container for belted rounds to be used in conjuction with automatic guns in an aircraft including a longitudinally extending channel having a width corresponding at least approximately to a length of single round and a height equal to a diameter or an integral multiple of the diameter of the round; an ammunition feeding channel is on one end of the container channel and a belt introducing device as provided either on the same or on the opposite end of the container channel; a loading device, preferably a winch with crank and bracket is provided for pulling rounds on a belt into the channel and said one is located at the opposite end of the container channel; the container channel has multiple layers, there being deflection means to provide a continuous channel through the multiple layers.

6 Claims, 1 Drawing Sheet

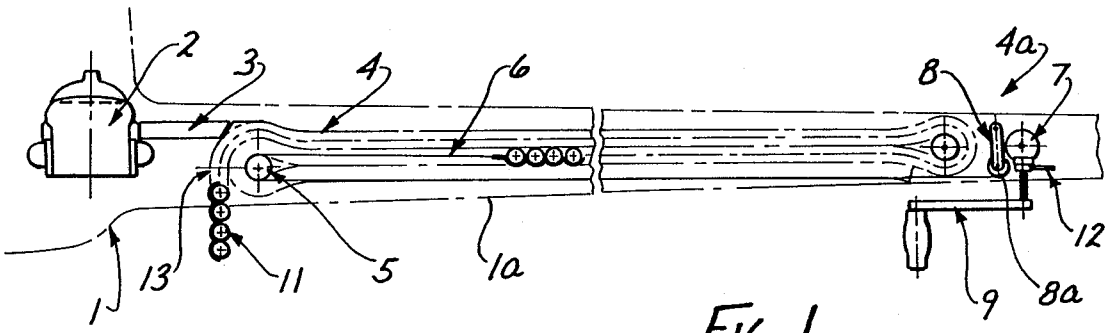
FIG. 1
FIG. 2
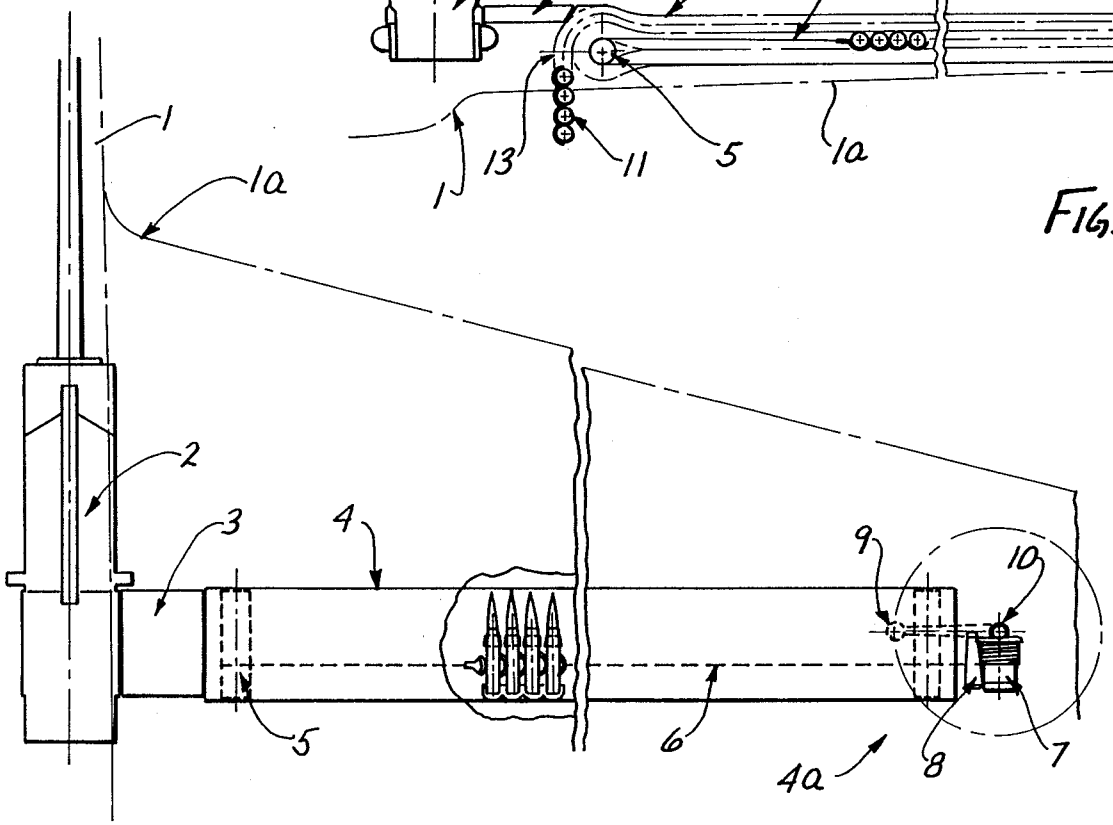

ON-BOARD AMMUNITION CONTAINER

BACKGROUND OF THE INVENTION

The present invention relates to a container for ammunition, particularly ammunition to be used in conjunction with automatic guns and being arranged in a belted fashion. Automatic guns in aircraft are commonly used in modern warfare. Shells of 27 mm caliber are used here and up to 150 rounds are often put in one belt.

DESCRIPTION OF THE INVENTION

It is an object of the present invention to provide a new and improved container for such ammunition which is better matched than in the past to the spatial limitations in aircraft and permits ready refilling and replenishment.

In accordance with the preferred embodiment of the present invention the object is attained through the provision of a longitudinally extending channel having a width which corresponds approximately to the length of a shell plus cartridge configuration with a height of the channel being approximately equal to the largest diameter of the round or an integral multiple thereof; one end of the channel is provided with a feeder channel. That end or the opposite end is provided with a load device for pulling a belt into the container and a belt loading and feeding facility is provided on the respective channel end. The channel may be provided with plural layers, and the container may be provided with an individual drive automatic or manual. The loading device is preferably constructed as a winch for a cable, rope or ribbon and includes a brake for that cable. The brake may be constructed as spring loaded rocker.

It can thus be seen that owing to the fact that the principal construction of the container is to be of a longitudinally extending channel the container may be provided to extend all the way to the end of the wing, even in the case of relatively thin wings, and even then up to three layers of rounds can be provided for. Preferably the number of layers is odd while the loading occurs always at the opposite end as compared with the gun itself. In case the number of layers is even loading must be from the same side as the disposition of the gun. Preferably a secondary drive is provided as stated for accelerating the rounds during shooting or for pulling fresh rounds into the container. This may include a booster motor of a hydraulic type and the hydraulics is operated in the existing system in the aircraft or alternatively an electrically motor is used to run off the electrical energy available in the aircraft.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 and FIG. 2 are front and top elevation of a container constructed in accordance with the present invention for practicing the best mode configuration using three layers of rounds in the container.

Proceeding to the detailed description of the drawings, FIG. 1 shows a container in an aircraft 1, as seen here from the front. The container is assumed to be mounted in a very thin wing 1*a* of the type used in a supersonic aircraft. A gun 2 is mounted in the fuselage structure of the aircraft, a feeder channel 3 for ammunition is provided between the gun 2 and the container constructed in accordance with the preferred embodiment of the present invention.

The munition storing container includes a longitudinal channel 4 which is provided for holding three layers of rounds. Two deflection points are inherently provided in such a container defined specifically by deflection pulleys 5. The rounds are held in the belt 11 which is permitted readily to slide over the deflection pulleys 5.

For threading the belt 11 into the container one needs a cable, string, rope or ribbon which can be wound onto or paired from a winch 7. A brake for the winch is provided which is comprised of a rocking lever 8 having a brake element which is being pulled by operation of the tension spring 12 upon the winch 7 and causing it to brake. At the end of the lever 8 a roller 8*a* is provided which runs and guides the loading rope, cable 6 etc. This roller 8*a* pulls the lever 8 away from the winch 7 on reloading the gun 2. This way the cable, rope 6 is released.

A reloading channel 13 is provided at the same end of the container as the feeding channel 3 to provide new ammunition. For refilling the container a hand crank 9 is provided for use on ground by means of which through on opening of the skin of the aircraft, the winch 7 can be operated through bevel gear 10. FIG. 2 illustrates specifically how the straight channel readily accommodates a long thin wing.

It can readily be seen that the container can be releasably fastened to the load carrying structure of the aircraft. Loading includes winch 7 as stated and one end of the belt is fastened to the rope, cable etc. 6 to unwind automatically on shooting. After all of the ammunition has been spent the end of the cable 6 appear directly as the gun 2 but also at channel 13. This permits a new belt to be attached to the cable 6 and either through a motor or through the externally operated crank 9 or any other moving device a new belt with ammunition is pulled into the channel 4. 4*a* is the end of the channel at the loading winch operating device end. If the number of layers is even then that winch etc. must be situated near (but below) the feeder replenishing channel 13.

The brake 8 provides primarily a suppression of oscillation of the rope or cable 6 as well as uncontrolled release. The winch brake includes spring loaded lever 8 and that is a very simple device which is advantageous by and in itself on that account alone. The lever is constructed as a rocker and brakes the drum of the winch, and at the front of lever 8 there is a roller 8*a* as stated for engaging the cable. During shooting, that means that while the gun is being reloaded automatically, the cable is pulled and the brake is automatically released so that the cable lifts the deflection pulley and the brake lever from the winch drum. Following shooting the spring pulls the brake lever towards the drum which stops accordingly.

The various parts can be made of suitable material. There is a wide choice available. Synthetic compound materials, or sheet metal container can be used. Today it is possible to make such a container of a very light weight without loss in stability. The light weight of the container is of course an important feature for carrying it in an aircraft and particularly in the wing. A releasable structure is provided to permit the container to exchange as it may become necessary in some cases.

The invention is not limited to the embodiments described above but all changes and modifications thereof, not constituting departures from the spirit and scope of the invention, are intended to be included.

I claim:

1. An ammunition container for belted rounds to be used in conjunction with automatic guns in an aircraft comprising:

an ammunition belt;

rounds of ammunition having a length and a diameter;

means defining a longitudinally extending principal channel having a width which corresponds at least to the length of a single round and a height equal to at least one diameter of a round;

said channel having two ends, an ammunition feeding end and a belt introducing end; and a loading device including a loading cable connected to the belt and a winch connected to the cable for pulling the cable, belt and rounds on the belt into the belt introducing end of the channel for reloading the container, the loading cable being unwound from the winch during ammunition feeding from the ammunition feeding end of the channel.

2. A container as in claim 1, said channel being of straight configuration.

3. A container as in claim 1 the channel having multiple layers there being deflection means to provide a continuous channel through the multiple layers.

4. A container as in claim 1, further comprising drive means to operate the loading device.

5. Container as in claim 1 including a winch brake.

6. A container as in claim 5 the winch brake including a spring loaded rocker with a cable guide roller.

* * * * *